US007012206B2

(12) United States Patent
Oikawa

(10) Patent No.: US 7,012,206 B2
(45) Date of Patent: Mar. 14, 2006

(54) WATERPROOF KEYBOARD

(75) Inventor: Hiroaki Oikawa, Ichikawa (JP)

(73) Assignee: Keytec Corporation, Chiba (JP)

( * ) Notice: Subject to any disclaimer, the term of this patent is extended or adjusted under 35 U.S.C. 154(b) by 0 days.

(21) Appl. No.: 11/099,568

(22) Filed: Apr. 6, 2005

(65) Prior Publication Data

US 2005/0224326 A1 Oct. 13, 2005

(30) Foreign Application Priority Data

Apr. 7, 2004 (JP) ..... 2004-113433

(51) Int. Cl.
*H01H 9/04* (2006.01)

(52) U.S. Cl. ..... 200/302.1; 200/302.2

(58) Field of Classification Search ..... 200/302.1, 200/302.2, 5 A, 341, 344; 400/714, 496, 400/472

See application file for complete search history.

(56) References Cited

U.S. PATENT DOCUMENTS 5,300,742 A * 4/1994 Huang ..... 200/302.2
6,088,531 A * 7/2000 Endoh ..... 396/29
6,215,420 B1 * 4/2001 Harrison et al. ..... 341/22
6,610,944 B1 * 8/2003 Lee et al. ..... 200/302.1
6,705,787 B1 * 3/2004 Jeffries et al. ..... 400/714
6,917,000 B1 * 7/2005 Yen ..... 200/5 A
2002/0097171 A1 7/2002 Oikawa

FOREIGN PATENT DOCUMENTS

JP 9-305281 A 11/1997
JP 10-222267 A 8/1998

* cited by examiner

*Primary Examiner*—Richard K. Lee
(74) *Attorney, Agent, or Firm*—Birch, Stewart, Kolasch & Birch, LLP

(57) ABSTRACT

A waterproof keyboard includes a generally flat key panel supporting keytops thereon. Membranes support thereon key contacts and connecting circuits for the contacts, and are supported by a generally flat support base, corresponding in shape to the key panel. Between the membranes and the key panel, a waterproof layer is supported by the support base for sealing the membranes in cooperation with the base. The waterproof layer, made of a sheet of flexible synthetic resin, is pressed with an elongate elastic member against the edge portion of the support base. The key panel is fixed to the support base to cause the waterproof layer and support base to seal the membranes, which will surely be protected from dust and moisture.

8 Claims, 9 Drawing Sheets

WATERPROOF KEYBOARD

BACKGROUND OF THE INVENTION

1. Field of the Invention

The present invention relates to a keyboard and more particularly to a full keyboard, ten-key pad or similar manual inputting device.

2. Description of the Background Art

Keyboards in general are provided with various kinds of waterproof, dustproof structures, e.g. simple waterproof structures for daily use and sophisticated waterproof structures for medical and other professional use. For example, Japanese patent laid-open publication Nos. 10-222267 (Prior Art Document 1 hereinafter) and 9-305281 (Prior Art Document 2 hereinafter) each disclose a keyboard applicable to a personal computer and including an elastic waterproof cover configured to cover a support panel on which key switches are arranged. The waterproof cover mentioned above prevents oil mist and vapor from penetrating into switch devices included in the key switches. More specifically, the waterproof cover cooperates with a support base to fully cover the switch devices arranged on the support panel, which is positioned between the cover and the support base, thereby blocking dust and moisture from entering. When any one of keytops positioned above the elastic waterproof cover is depressed, the keytop presses the corresponding switch device via the cover.

Prior Art Documents 1 and 2 described above both have a problem that the waterproof mechanism is solid and therefore requires members exclusively prepared for the waterproof structure to be assembled, resulting in high production cost.

SUMMARY OF THE INVENTION

It is an object of the present invention to provide a waterproof keyboard establishing high sealability with a simple structure while insuring a keytouch as agreeable with that of a conventional keyboard.

A waterproof keyboard of the present invention includes a first frame generally flat and supporting a plurality of keytops. A circuit support supports key contacts and connecting circuits for the contacts. The circuit support is supported by a second frame, which is also generally flat and corresponds in shape to the first frame to constitute a base. The second frame supports a waterproof layer, which intervenes between the circuit support and the first frame for sealing the circuit support in cooperation with the second frame. The waterproof layer is pressed with an elongate elastic member against the edge portion of the second frame. The first and second frames are fixed with a fastener to each other with the elastic member intervening between them to thereby cause the waterproof layer and second frame to seal the circuit support. In this configuration, the circuit support is surely protected from dust and moisture.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
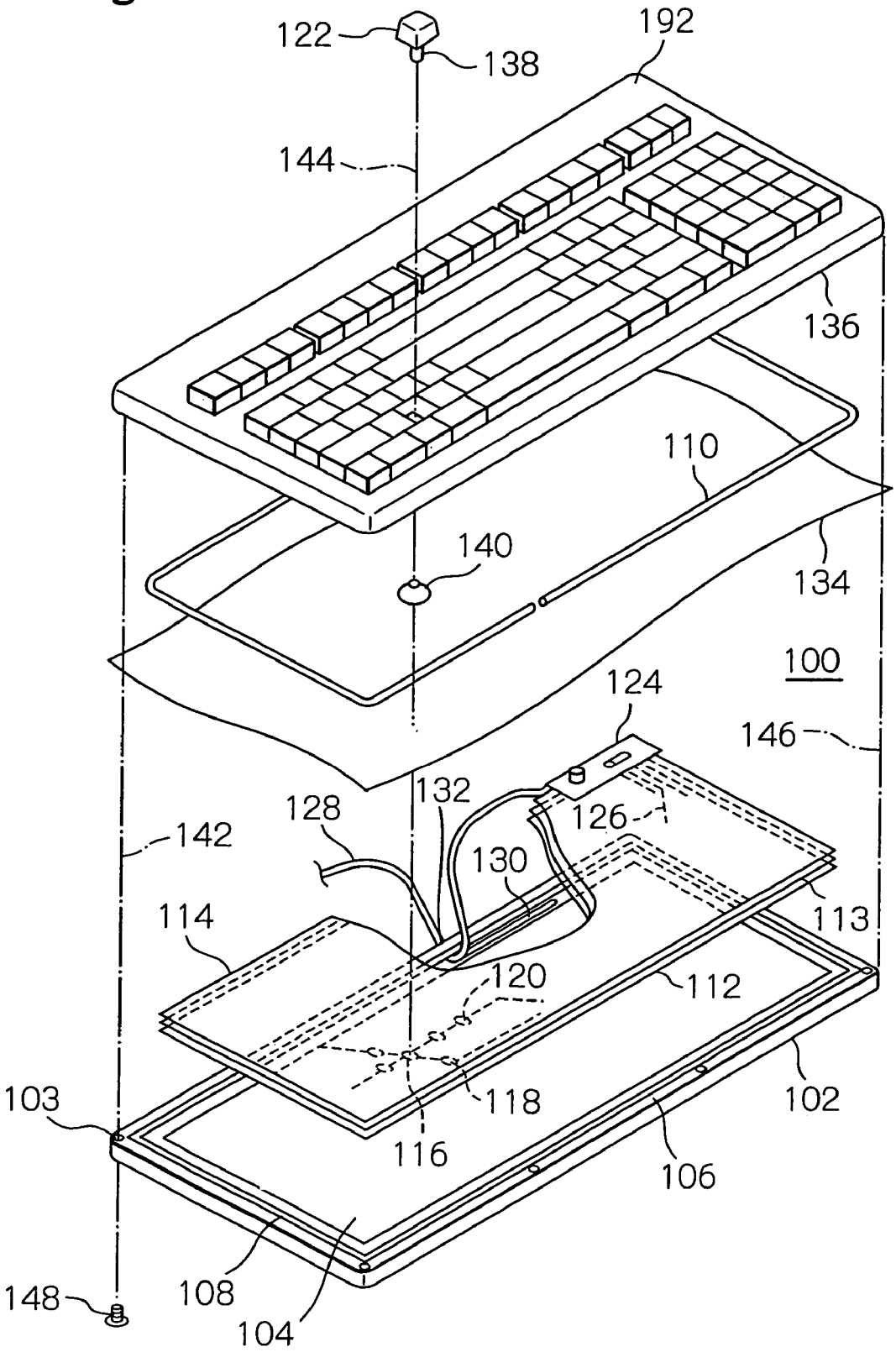
FIG. 1 is a partly taken away, exploded perspective view showing a preferred embodiment of the waterproof keyboard in accordance with the present invention.

Referring to FIG. 1 of the accompanying drawings, a preferred embodiment of the waterproof keyboard in accordance with the present invention is generally directed to a keyboard 100 which may be implemented as a 106 keyboard or similar general-purpose full keyboard for use with a personal computer and provided with standard key layout.

The keyboard 100 includes a support base 102 positioned at the bottom of the keyboard 100 in the figure and functioning as a support body. The support base 102 is implemented as a frame molding of synthetic resin which has its configuration generally flat and substantially rectangular in planer shape. The support base 102 has its bottom and peripheral sides formed with no holes, except for screw holes 103. The support base 102 has its inner portion formed with a depression 104 in some depth. The depression 104 has its configuration also generally rectangular and substantially flat with its four peripheral sides surrounded by an edge portion 106, which is slightly higher in level than the bottom of the depression 104.

The support base 102 also has a groove 108 formed in and along its edge portion 106. In the illustrative embodiment, the groove 108 has its cross-section generally semicircular or U-shaped, as seen in a plane perpendicular to the general plane of the support base 102 inclusive of the bottom of the depression 104. The groove 108 is so sized as to receive a pressing member 110, when the keyboard 100 is assembled, via a thin sheet 134 formed of synthetic resin, as will be described later more specifically. It is to be noted that the shape of the cross-section of the groove 108 mentioned above is only illustrative and may, of course, be replaced with a rectangular or other cross-sectional shape.

In the depression 104 of the support base 102, two key switch membranes 112 and 114 are stacked with a spacer 113 placed in between. The key switch membranes (simply membranes hereinafter) 112 and 114 are paired to play the role of a circuit support, which will be described later specifically, and may be provided with any configuration which is known itself.

More specifically, the lower membrane 112 below the spacer 113 in FIG. 1 is implemented as a generally rectangular, flexible sheet formed of synthetic resin and having substantially the same area as the depression 104. The lower membrane 112 has its upper surface in the figure formed in printing with one electrode 118 assigned to a contact 116, which constitutes a key switch, and a wiring circuit pattern associated with the electrode 118. Likewise, the upper membrane 114 above the spacer 113 in the figure is also implemented as a generally rectangular, flexible sheet formed of synthetic resin and having substantially the same area as the membrane 112. The upper membrane 114 has its lower surface formed in printing with the other electrode 120 of the contact or key switch 116 and a wiring circuit pattern associated therewith, as seen in FIG. 1.

The spacer 113, intervening between the membranes 112 and 114, is formed of an electrically insulating material and provided with a generally flat, rectangular configuration. The spacer 113 has substantially the same area as the membrane 112 or 114. The spacer 113 has its through hole, which is circular in the illustrative embodiment, formed therein at a position corresponding to the electrodes 118 and 120 of the contact 116, although not shown specifically in FIG. 1. In this configuration, when the operator of the keyboard 100 depresses a keytop 122, which will be described later, the electrodes 118 and 120 of the contact 116 are brought in contact with each other through the above circular hole, closing or completing an electric circuit associated with the keytop 122.

The membranes 112 and 114 are paired, when assembled, and have a circuit board 124 mounted on part of one membrane 124, e.g. around its one corner portion with the embodiment, although the corner portion is only illustrative and may be replaced with any other suitable portion. The circuit board 124 has electronics, now shown, carried thereon to which a wiring pattern 126, extending from the contact 116, is interconnected. The above circuit of the circuit board 124 has a connection code 128 connected thereto. When the keyboard 100 is fully assembled, as illustrated, the connection code 128 is received in a slot 130 formed in the edge portion 106 of the support base 102 and passes a hole 132 to extend to the outside of the keyboard 100. A clearance between the hole 132 and the connection code 128 will be waterproofed by a packing or a sealing resin not shown. The connect code 128 has its remote end positioned outside the keyboard 100 and interconnected to a utility device such as a personal computer, although not shown specifically in FIG. 1.

Well, in the illustrative embodiment, the previously mentioned thin sheet 134, which is flexible and extendible, is positioned above the membranes 112 and 114 in the figure. The thin sheet 134 comprises a flat, thin film-like sheet formed of polyethylene terephthalate (PET), vinyl chloride, polyethylene or similar synthetic resin and covers the entire upper surface of the membrane 114, inclusive of the circuit board 124, constituting a waterproof layer. The thin sheet 134 will, when the pressing member 110 also mentioned earlier is fitted into the groove 108 from above, be fixed at its edge portion on the support base 108 together with the membranes 112 and 114.

The thin sheet 134 has substantially the same size as the outer contour of the support base 102 and may advantageously be implemented by, e.g. Poly Wrap (trade name) available from Shin-Etsu Polymer Co., Ltd. in the form of elongate film. If desired, such an elongate film may be directly fixed to the support base 108 by the pressing member 110 and then cut in an adequate size substantially matching with the size of the support base 108.

The pressing member 110 is implemented as an elongate string formed of silicone rubber, neoprene rubber or similar elastic resin and may be provided with a solid or a cellular or sponge-like structure, as desired. Further, the pressing member 110 may have a circular, rectangular or similar cross-section substantially matching with the cross-section of the groove 108. When the pressing member 110 with such a configuration is pressed into the groove 108 with the thin sheet 134 intervening, the pressing member 110 firmly fixes the sheet 134 to the support base 102 with its own elasticity.

On the top of the structure described so far, mounted is a key panel 136, which constitutes a frame that has its planer shape generally rectangular and corresponding to that of the support base 102. The key panel 136 movably supports a number of keytops 122 arranged thereon. The keytop 122, particularly shown, has its projection 138 protruding from the bottom portion for receiving a dome member 140. The keytop 122 and dome member 140 are, when joined together, positioned above the corresponding contact 116 with the thin sheet 134 intervening, thereby constituting a key switch corresponding to a single key.

The dome member 140, formed of silicone rubber or similar elastic synthetic resin, is made up of a hollow semispherical body and has its projection protruding upward in the figure from the top of the body. With the semispherical elastic body, the dome member 140 attains its click action. More specifically, when the keytop 122 is depressed downward in the figure against the elasticity of the dome member 140, the projection 138 of the keytop 122 presses the electrodes 118 and 120 of the contact 116 against the dome member 140 to thereby cause them to contact with each other. Subsequently, when the above keytop 122 is released, it is restored to its original position due to the elastic repulsion of the dome member 140. This kind of mechanism is generally referred to as a dome-click mechanism.

The repulsion available with the dome member 140, as mentioned above, provides the operator with an agreeable keytough. At this instant, the thin sheet 134, which is extremely thin, flexible and extendible, can sufficiently withstand the up-and-down movement of the keytop 122 and the resulting deformation of the dome member 140. Moreover, the thin sheet 134 successfully seals up the electric circuitry and mechanical contacts provided on the membranes 112 and 114 and circuit board 124 from the outside, blocking dust and moisture in both of the up-and-down and left-and-right directions.

It should be noted that FIG. 1 shows only a single set of keytop 122, dome member 140 and contact 116 for the sake of simplicity of illustration. In practice, a great number of, e.g. 112 keytops, 112 dome members and 112 contacts are, of course, arranged in the form of a key matrix. In the figures, identical or similar structural members or elements are designated by identical reference numerals.

The structural members described above are assembled, as indicated by dash-and-dot lines 142, 144 and 146 in FIG. 1. At the end of the assembly, the key panel 136 is mounted onto the support base 102 and then fixed thereon with screws 148 or any other suitable fastening means at a plurality of adequate peripheral portions. As a result, the peripheral portion of the key panel 136 is pressed against the peripheral portion 106 of the support base 102 under adequate pressure via the pressing member 110. Such pressure, coupled with the elasticity of the pressing member 110, implements a fully watertight sealing mechanism, thereby completing the waterproof keyboard 100. While the key panel 136 and support base 102 may, of course, be fastened together at the center portion as well, they are fastened only at the peripheral portion in the illustrative embodiment because a screw hole around the center of the keyboard 100 is not desirable from the waterproof standpoint.

Figure 2:
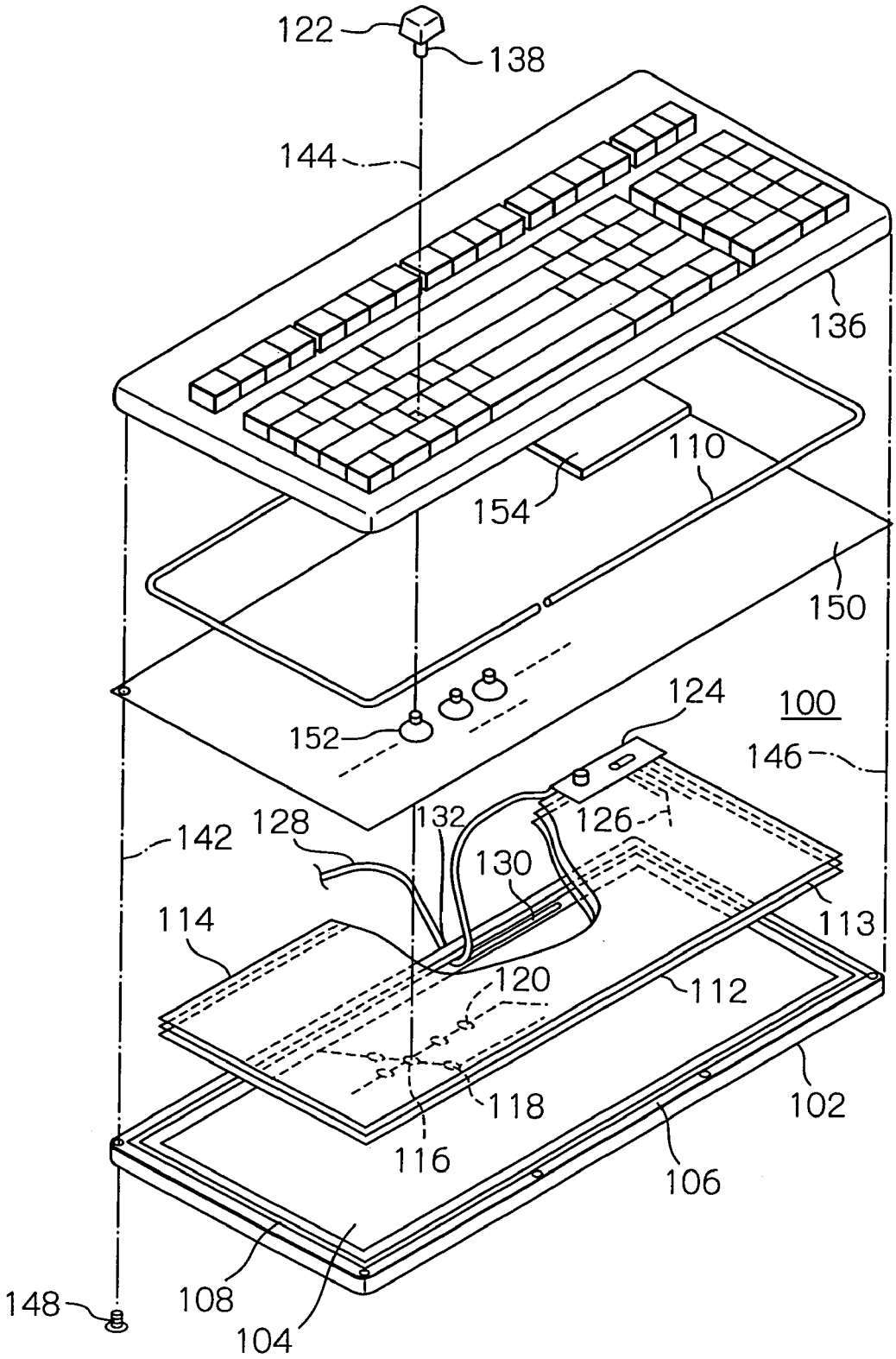
FIG. 2 is a view, similar to FIG. 1, showing an alternative embodiment of the present invention.

Referring now to FIG. 2, an alternative embodiment of the waterproof keyboard in accordance with the present invention is substantially identical with the previous embodiment except that a waterproof sheet 150 is substituted for the thin sheet 134 and dome member 140. The waterproof sheet 150 has substantially the same size as the outer contour of the support base 102 and is formed of silicone, neoprene or similar elastic synthetic resin, constituting a waterproof layer. The waterproof sheet 150 is about 0.7 mm thick by way of example and so positioned as to cover the upper surface of the membrane 114 inclusive of the circuit board 124.

With the waterproof sheet 150, integrally are molded a number of domes or projections 152, corresponding to the dome members 140 shown in FIG. 1, in such a manner as to protrude from the upper surface of the sheet 150 in FIG. 2. The domes 142 are as agreeable as the dome members 140 as to the keytouch. Also, integrally with the waterproof sheet 150, a projection or raised portion 154 is formed in such a manner as to protrude from part of the upper surface of the sheet 150 that overlies the circuit board 124. The projection 154 is hollow and open at the bottom in FIG. 2, although not visible, and capable of accommodating the circuit board 124 and an integrated circuit, light-emitting diodes and other circuit devices mounted on the circuit board 124.

In assembly, the pressing member 110 is fitted in the groove 108 from above the edge portion of the waterproof sheet 150, so that the sheet 150 is fixed to the support base 108 together with the membranes 112 and 114 like the thin sheet 140 of the previous embodiment. The pressing member 110 and groove 108 included in the illustrative embodiment are not essential. Alternatively, a portion that corresponds in configuration to the pressing member 110 may be molded integrally with the edge portion of the waterproof sheet 150 and fitted in the groove 108 in order to fix the sheet 150 to the support base 102.

In those embodiments described above, the thin sheet 134 or the waterproof sheet 150, playing the role of a flexible, extendible waterproof layer, is fixed to the support base 102 firmly by the pressing member 110. This implements a waterproof, dustproof mechanism that seals the electric circuitry and mechanical contacts formed on the membranes 112 and 114 and circuit board 124 from the outside of the keyboard 100 in both of the up-and-down and right-and-left directions.

Figure 3:
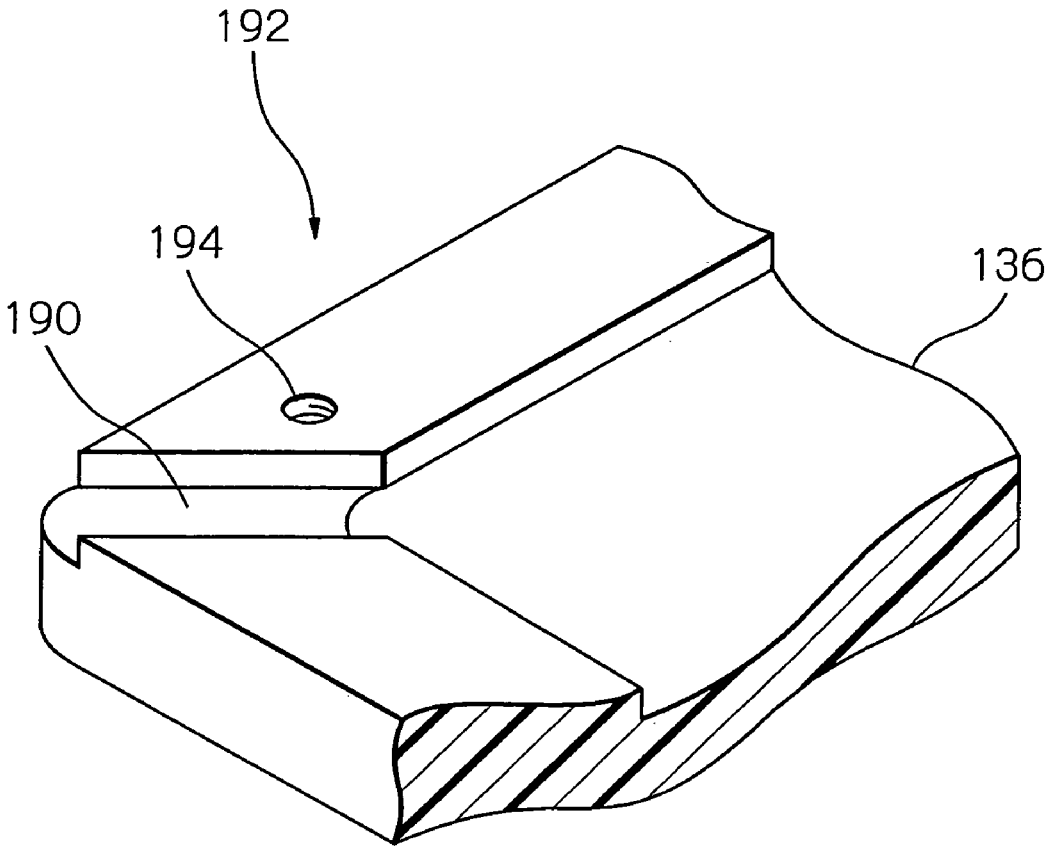
FIG. 3 is a fragmentary isometric view showing one corner portion of a key panel included in the embodiment of FIG. 1.

FIG. 3 shows a ditch or channel 190 which is formed in one of the four corner portions, e.g. 192, of the key panel 136 shown in FIG. 1. In the figure, the corner portion 192 is viewed from the bottom in FIG. 1. When the key panel 136 is mounted in assembly on the support base 102, the ditch 190 forms a tube-like space together with the flat edge portion 106 of the support base 102 to form a drain. The ditch 190 is formed to be slightly inclined downward toward the outside of the keyboard 100 so as to guide water or similar liquid, which would otherwise stay on the top of the thin sheet 134 by accident, to the outside of the keyboard 100. Additionally, also shown in FIG. 3 is a screw hole 194 formed in the key panel 136 for receiving the screw 148, FIG. 1, driven into the support base 102. The ditch 190 may be applied to the embodiment of FIG. 2 as well, if desired.

Figure 4:
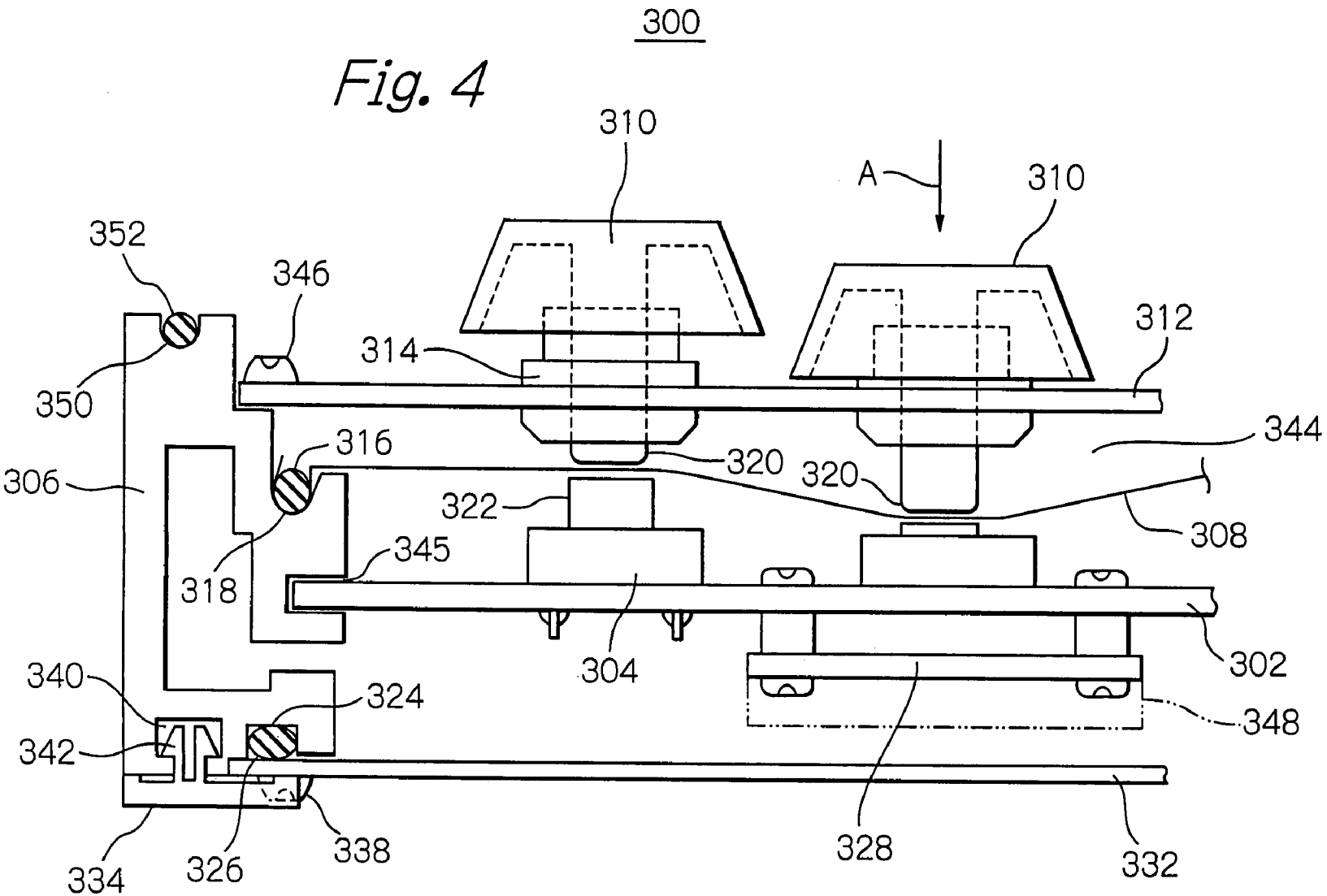
FIG. 4 is an enlarged, partially sectional side elevation showing part of another alternative embodiment of the present invention.
Figure 5:
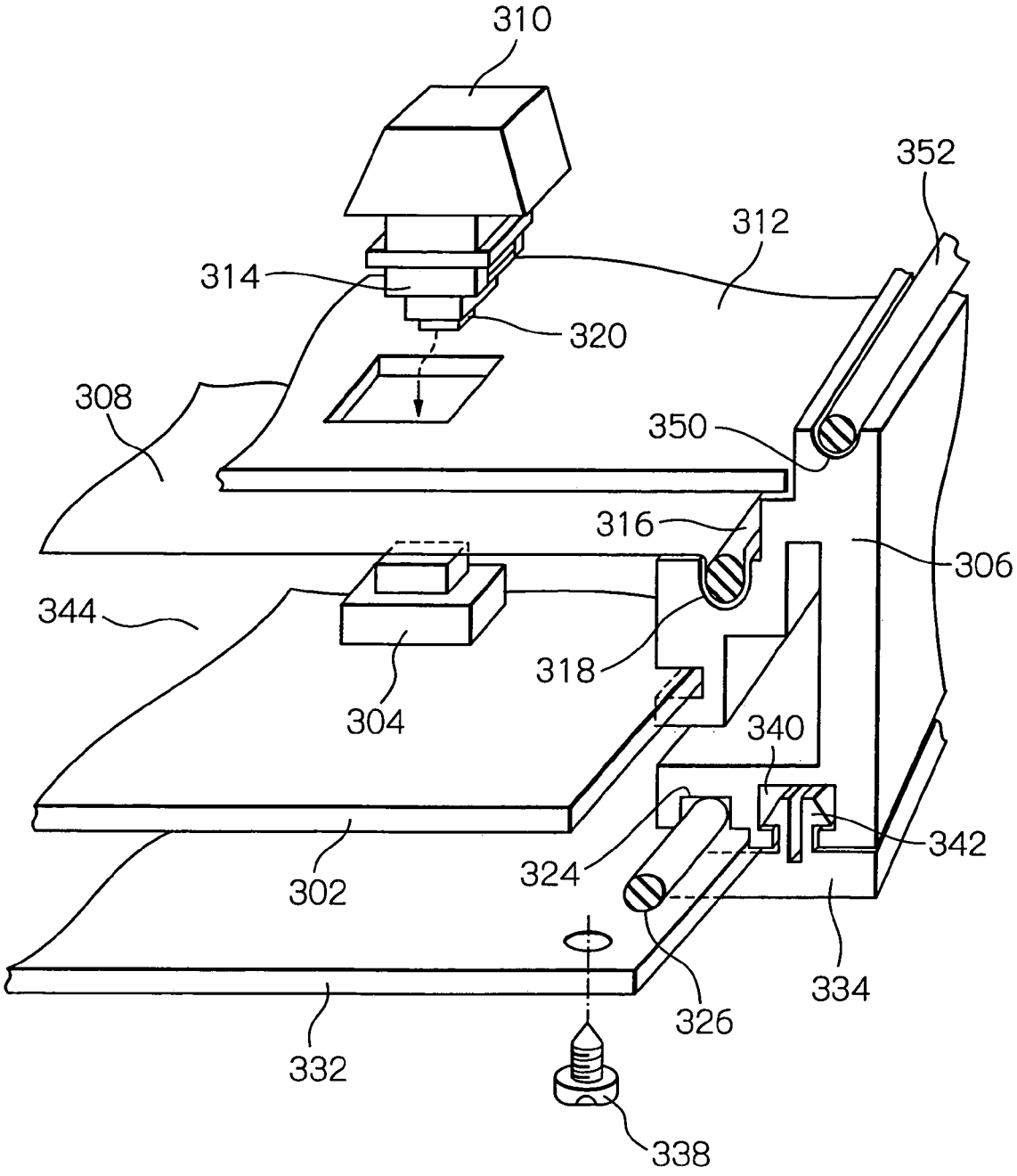
FIG. 5 is a partly exploded perspective view showing part of the embodiment of FIG. 4.

Referring to FIGS. 4 and 5, another alternative embodiment of the waterproof keyboard in accordance with the present invention is shown in a fragmentary side elevation and a fragmentary perspective view, respectively. The illustrative embodiment is advantageously applicable to, e.g. a flexibly designable keyboard disclosed in co-pending U.S. patent application Ser. No. 10/051,084 filed in the name of the same applicant as the present application.

As shown in FIGS. 4 and 5, the waterproof keyboard, generally 300, includes a switch circuit board 302 supporting a number of key switches 304. The switch circuit board 302 is supported by an elongate frame member 306 with its edge portion being received in a channel 345 formed in the frame member 306, as illustrated. The switch circuit board 302 has another circuit board 328, similar to the circuit board 124, FIG. 1, mounted thereon. The circuit board 328 has a circuit device, such as a keyboard encoder, 348 mounted thereon.

The key switches 304 each are mechanically connected to a particular keytop 310 with a waterproof sheet 308 intervening. The keytop 310 is movably supported by a key panel 312 via a keytop guide member 314. The key panel 312, also supported by the frame member 306, comprises an aluminum sheet or similar metallic sheet fixed to four corner members 330 (see FIG. 6) by screws 346. In this configuration, each keytop 310 is slidable in the up-and-down direction in FIG. 4. While FIG. 4 shows only two sets of key tops 310, key switches 304 and so forth, a number of such sets are, of course, included in the keyboard 300.

The waterproof sheet 308 is formed of silicone rubber or similar flexible, extendible material as in the embodiment shown in FIG. 1 and positioned at a level or height between the bottoms 320 of the keytops 310 and the upper ends 322 of the key switches 304. The waterproof sheet 308 has its peripheral portion fixed on the frame member 306 with a pressing member 316 fitted from above in a groove 318, which is formed in the frame member 306.

In the illustrative embodiment, repulsion that should cause each keytop 310 to rise in a click action is implemented by a spring mechanism built in the key switch 304 facing the keytop 310. More specifically, when any one of the keytops 310 is depressed downward in the figure under the pressure of, e.g. about 50 grams to 100 grams against the action of the above spring mechanism, the bottom 320 of the keytop 310 presses the top 322 of the corresponding key switch 304 for thereby connecting a pair of electrodes assigned to the corresponding contact to each other. Subsequently, when the keytop 310 is released, the pressure acting on the key switch 304 is canceled with the result that the keytop 310 is automatically restored to its original position by the repulsion of the spring mechanism, i.e. a mechanical click mechanism.

In the illustrative embodiment, the waterproof sheet 308, constituting a flexible, extendible waterproof layer, is firmly fixed to the frame member 306 by the pressing member 316 as in the embodiments described previously. This also implements a waterproof, dustproof mechanism that seals up the electric circuitry and mechanical contacts formed on the circuit board 124 and by the key switches 304 from the outside of the keyboard 300 in both of the up-and-down and right-and-left directions.

More specifically, the bottom of the frame member 306 in FIG. 4 has a groove 324 formed to run in the lengthwise direction. In the illustrative embodiment, the groove 324 is provided with a rectangular or a generally U-shaped cross-section to receive a waterproof string 326 therein. The waterproof string 326 is made of elastic material such as silicone rubber. The string 326 serves to seal a clearance which will be formed between the frame member 306 and a bottom plate 332, when mounted to the frame member 306, which will be described later.

Figure 6:
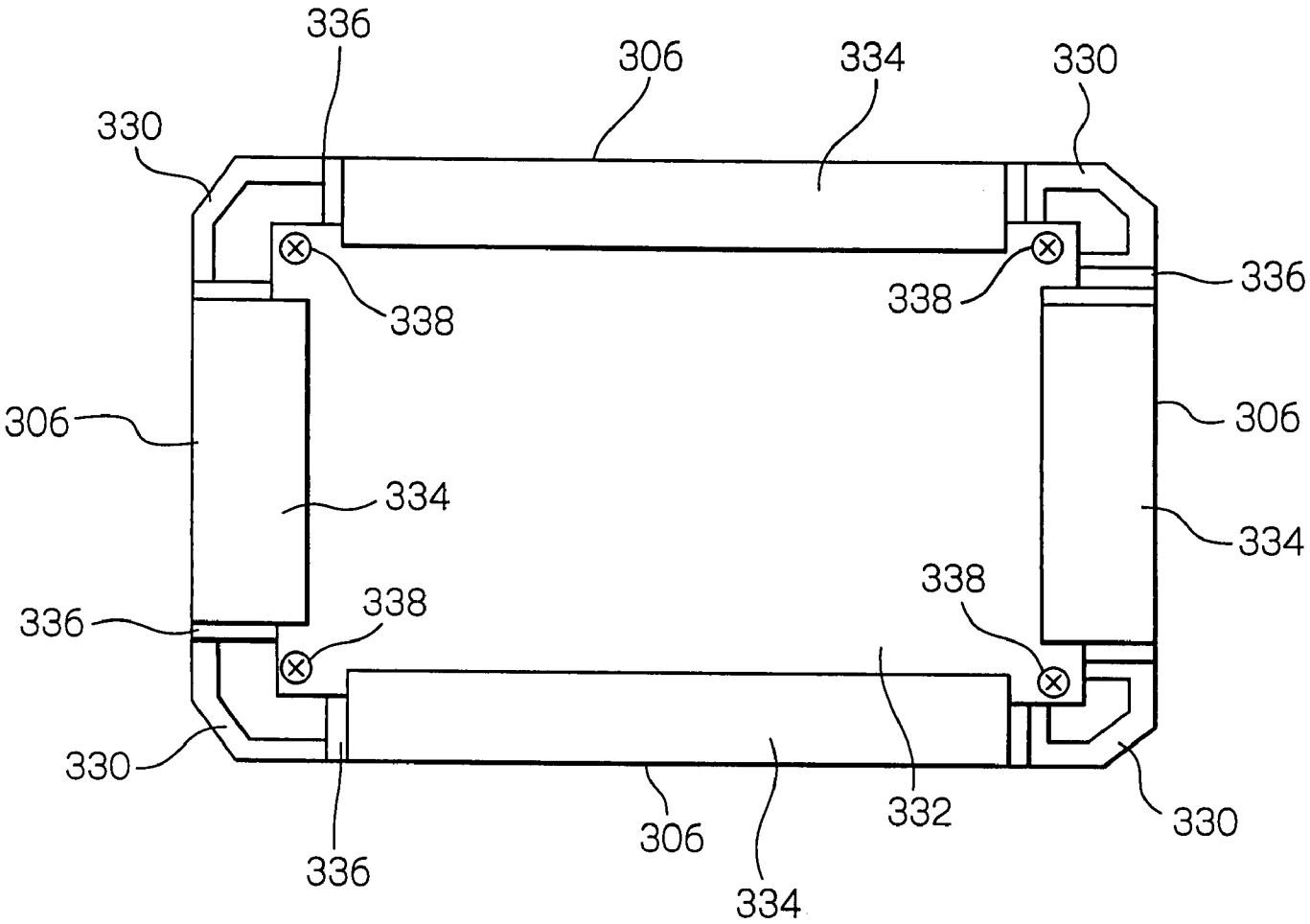
FIG. 6 is a bottom view showing the embodiment of FIG. 4.
Figure 7:
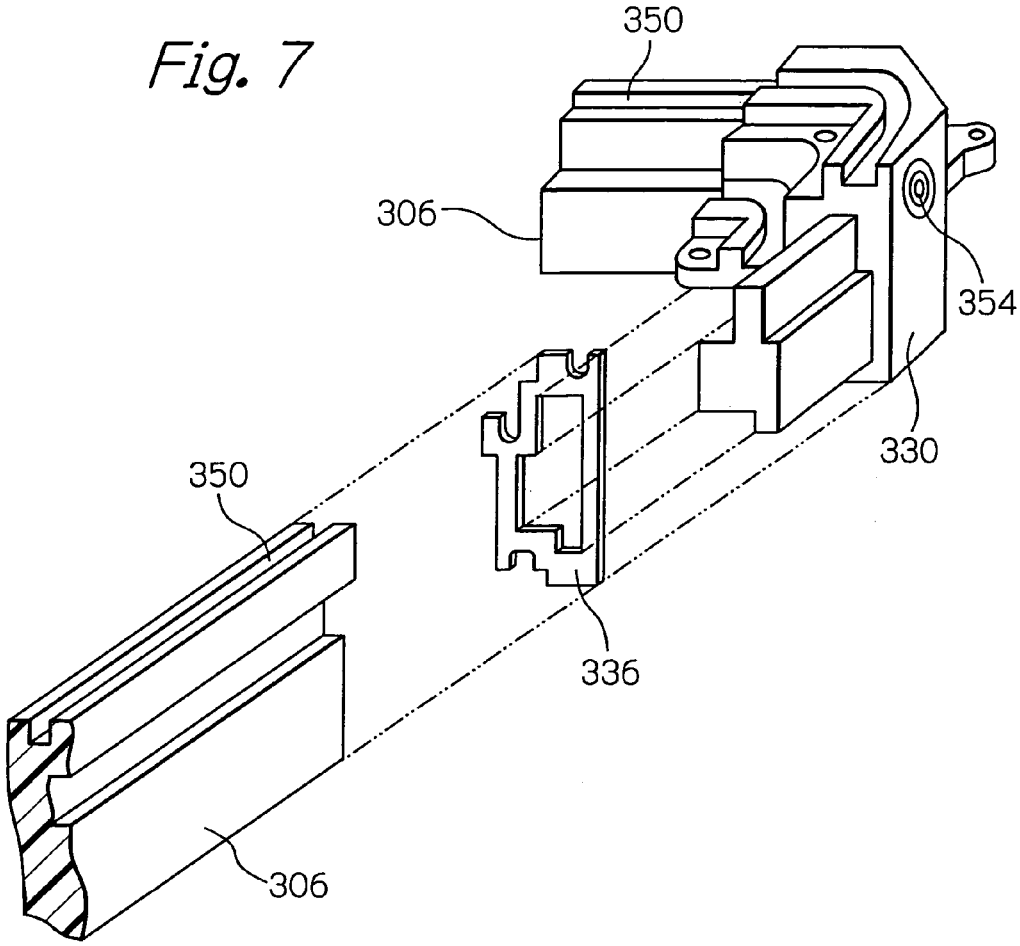
FIG. 7 is a fragmentary, exploded perspective view showing one corner portion of the embodiment of FIG. 4.

More specifically, as shown in FIGS. 6 and 7, four frame members 306, produced by extrusion molding of synthetic resin, are interconnected by four corner members 330 also molded of synthetic resin, constituting a generally rectangular frame. The keyboard 300 is thus provided with a free-size or flexibly designable configuration, i.e. key layout and size satisfying specifications desired by a customer. The bottom plate 332, implemented by an aluminum or similar metallic plate, is fastened to the corner members 330 at four corners thereof with screws 338. Further, the bottom plate 332 is fixed to the frame members 306 by means of elongate pressing bars 334 produced by extrusion molding.

Figure 8:
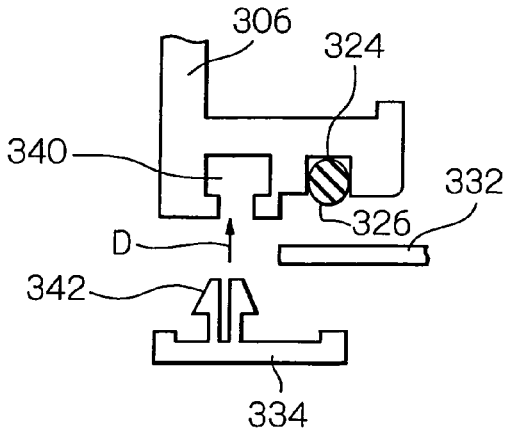
FIG. 8 is a view showing a structure for fixing a pressing bar and a bottom plate included in the embodiment of FIG. 4 to each other.

The frame member 306, of which the end surface is shown in FIG. 8, has a groove 340 formed in its bottom surface in the figure to run in its lengthwise direction. The groove 340 is adapted to removably receive an elongate lug 342, which is formed on the pressing bar 334 to oppose the groove 340. When the pressing bar 334 is mounted to the frame member 306 with the lug 342 being inserted into the groove 340 in a direction indicated by an arrow D in FIG. 8, the bar 334 presses the bottom plate 332 against the bottom of the frame member 306. Consequently, the elastic waterproof string 326 seals a space 344, FIG. 5, established between the bottom plate 332 and the waterproof sheet 308, preventing liquids and dust from entering the space 344 upward. Further, the four pressing bars 334 evenly press the edges of the bottom plate 332 to thereby prevent the bottom plate 332 from locally deforming at its central portion.

In the illustrative embodiment, the pressing bars 334 are implemented as members separate from the frame members 306. Alternatively, each pressing member 334 and corresponding frame member 306 may be molded integrally with each other, in which case the frame member 306 will be formed with a groove for receiving the edge of the bottom plate 332. Such an alternative scheme is also successful to achieve a sure watertight structure with the waterproof string 326.

Referring again to FIG. 7, two adjoining frame members 306 are connected together by one corner member 330. Between each frame member 306 and the corner member 330, a waterproof packing 336 is interposed, which is formed of silicone rubber or similar elastic material. The waterproof packing 336 with the configuration shown in FIG. 7 is also successful to seal the space 344 between the bottom plate 332 and the waterproof sheet 308.

The frame member 306 has another groove 350 formed in its top surface, in FIG. 7, to run in its lengthwise direction. The groove 350 is provided with a rectangular or a generally U-shaped cross-section to receive a waterproof string 352, FIG. 4. In an application of the illustrative embodiment in which the keyboard 300 is mounted on, e.g. the panel of user's apparatus, not shown, the waterproof string 352 seals a clearance between the above panel and the top of the frame member 306 to thereby prevent liquids and dust from entering the user's apparatus.

Figure 9:
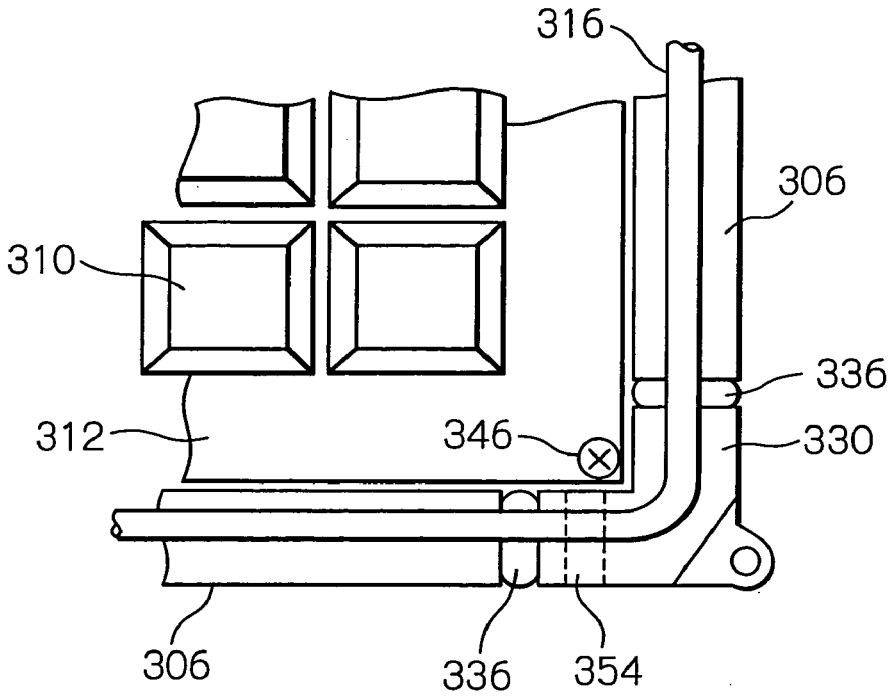
FIG. 9 is a fragmentary plan view showing one corner portion included in the embodiment of FIG. 4.
Figure 10:
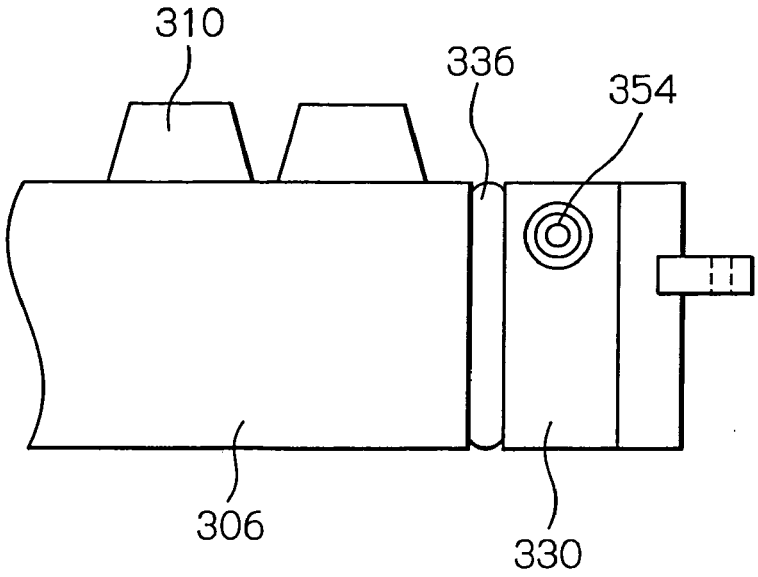
FIG. 10 is a side elevation of the corner portion of FIG. 9 as seen from the right in FIG. 9.
Figure 11:
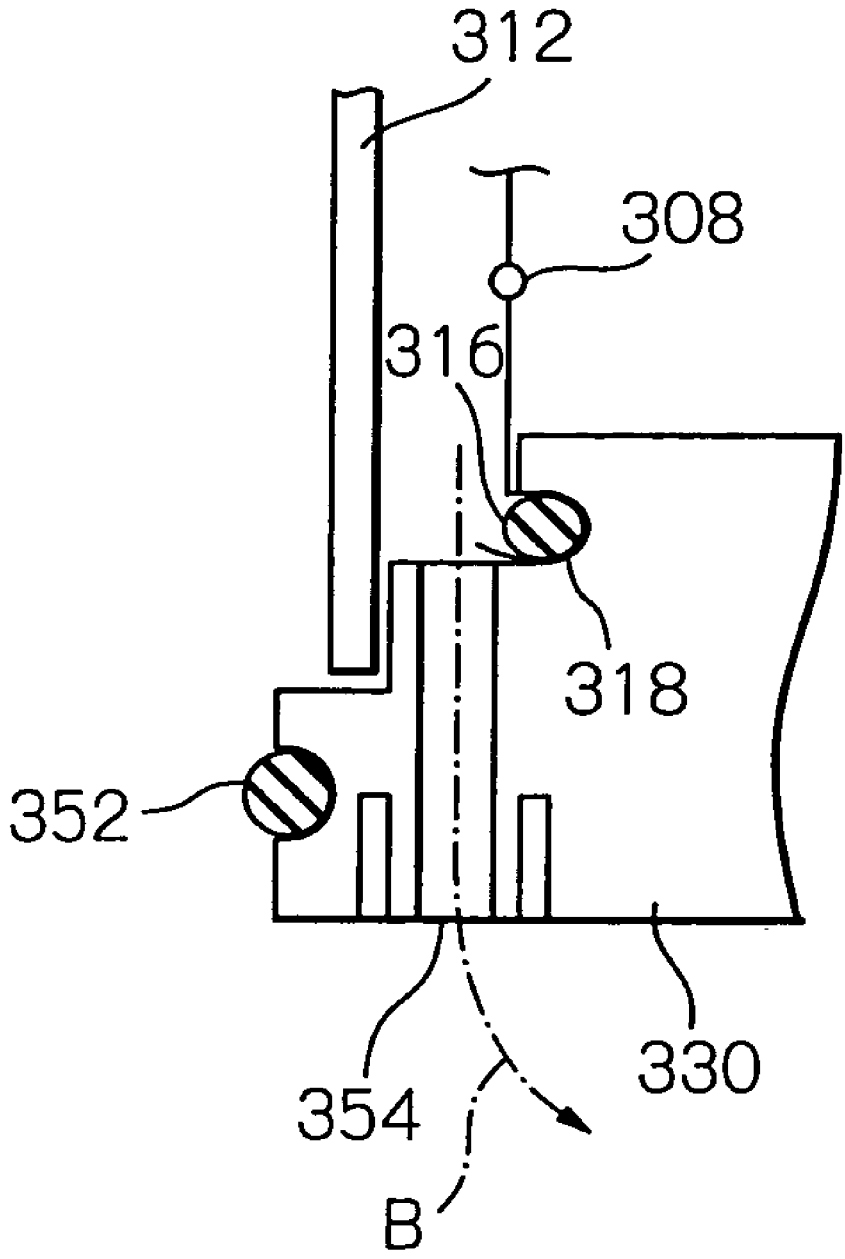
FIG. 11 is a side elevation showing the lower portion of the corner portion shown in FIG. 9.

The alternative embodiment also includes a drain hole 354 formed. As shown in FIGS. 9, 10 and 11, the drain hole 354 is formed in all or at least one of the four corner members 330 in such a manner as to play the same role as the ditch 190, FIG. 3. More specifically, such bores may not be cut in all the members 330, but may be closed when molded and at least one of them may be bored after molded up to form the drain hole 354 during assembling the frame members 306. In any case, the drain hole 354 is configured to discharge water or similar liquid, which would otherwise stay on the top of the waterproof sheet 308 by accident, to the outside of the keyboard 300, as indicated by an arrow B in FIG. 11.

In the specific application of the illustrative embodiment stated previously, a drainpipe formed of rubber, for example, may be connected to the drain hole 354 in order to protect the inside of the user's apparatus from water being discharged.

As shown in FIG. 4, when any one of the keytops 310 is depressed down in a direction indicated by an arrow A, the bottom 320 of the keytop 310 presses the flexible, extendible waterproof sheet 308 downward for thereby causing it to deform. As a result, an electric contact, built in the key switch 304 beneath the keytop 310, is closed. As FIG. 4 indicates, the waterproof sheet 308 should preferably be positioned at a level or height lying in the range of the up-and-down stroke of the key switch 304, more preferably substantially at the center of the above stroke. The waterproof sheet 308 is fixedly positioned at such a level by the pressing member 316 fitted in the grooves 318 of the frame members 306, which are positioned at the same level as the sheet 308. In this condition, the waterproof sheet 308 naturally accommodates the up-and-down stroke of the bottom 320 of the keytop 310, e.g. without being broken or torn off.

The entire disclosure of Japanese patent application No. 2004-113433 filed on Apr. 7, 2004, including the specification, claims, accompanying drawings and abstract of the disclosure is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What I claim is:

1. A keyboard comprising:

a first frame having a generally rectangular planer shape for supporting a plurality of keytops;

a circuit support supporting a corresponding plurality of key contacts and connecting circuits for said corresponding plurality of key contacts;

a second frame having a planer shape corresponding to the planer shape of said first frame and constituting a base for supporting said circuit support;

a waterproof layer intervening between said circuit support and said first frame, when supported by said second frame, to seal said circuit support in cooperation with said second frame;

an elongate elastic member pressing said waterproof layer against an edge portion of said second frame; and a fastener for fastening said first frame and said second frame to each other;

said waterproof layer being made of a flexible synthetic resin, said fastener pressing said first frame and said second frame against each other with said elongate elastic member intervening between said first frame and said second frame to thereby cause said waterproof layer and said second frame to seal said circuit support, whereby said circuit support is protected from dust and moisture.

2. The keyboard in accordance with claim 1, wherein said waterproof layer is formed of an elastic synthetic resin, and has a dome-click mechanism molded integrally with said waterproof layer for closing said key contacts.

3. The keyboard in accordance with claim 1, further comprising a corresponding plurality of dome members formed of an elastic synthetic resin for respectively engaging with said plurality of keytops, said waterproof layer comprising a thin, extendible sheet of synthetic resin, said plurality of dome members being made of an elastic synthetic resin and positioned between said waterproof layer and said first frame.

4. The keyboard in accordance with claim 3, wherein said circuit support comprises a membrane on which said plurality of key contacts and said connecting circuits are arranged, said waterproof layer being positioned at substantially a same level as said circuit support in a direction perpendicular to a general plane formed by said second frame.

5. The keyboard in accordance with claim 1, wherein said waterproof layer comprises a thin, extendible sheet of synthetic resin, and is positioned at substantially a same level as switch devices respectively including said plurality of key contacts in a direction perpendicular to a general plane formed by said second frame.

6. A keyboard comprising:

a keytop support having a generally rectangular planer shape for supporting a plurality of keytops;

a circuit support supporting a corresponding plurality of key contacts and connecting circuits for said corresponding plurality of key contacts;

a frame having a contour corresponding to the planer shape for supporting said circuit support;

a waterproof layer intervening between said circuit support, when supported by said frame, and said keytop support for sealing said circuit support in cooperation with said frame;

an elongate elastic member fitted in an edge portion of said frame to press said waterproof layer against said edge portion;

a bottom plate positioned at a side opposite to said keytop support with respect to said circuit support, when supported by said frame, for closing an opening of said frame; and a fixing device for sealing a clearance between said bottom plate and said frame and fixing said bottom plate to said frame;

said waterproof layer being made of a flexible synthetic resin, said elongate elastic member sealing said waterproof layer to an edge portion of said frame to thereby protect said circuit support from dust and moisture.

7. The keyboard in accordance with claim 6, wherein said fixing device includes a groove formed in said frame for receiving an edge of said bottom plate.

8. The keyboard in accordance with claim 6, wherein said fixing device includes a pressing member engaged with said frame to thereby support an edge of said bottom plate.

* * * * *